US005145010A

United States Patent [19]

Danielsson et al.

[11] Patent Number: 5,145,010

[45] Date of Patent: Sep. 8, 1992

[54] METHOD OF MAKING MECHANICAL PULP

[75] Inventors: K. Ove Danielsson, Stockholm; Bo G. S. Falk, Järfälla, both of Sweden; Michael Jackson, North Vancouver, Canada

[73] Assignee: Sunds Defibrator Industries Aktiebolag, Sweden

[21] Appl. No.: 488,037

[22] PCT Filed: Jan. 11, 1989

[86] PCT No.: PCT/SE89/00004

§ 371 Date: May 15, 1990

§ 102(e) Date: May 15, 1990

[87] PCT Pub. No.: WO89/06717

PCT Pub. Date: Jul. 27, 1989

[30] Foreign Application Priority Data

Jan. 22, 1988 [SE] Sweden ..... 8800200

[51] Int. Cl.[5] ..... D21B 1/16

[52] U.S. Cl. ..... 162/26; 162/28; 162/55; 162/78; 162/24

[58] Field of Search ..... 162/25, 26, 28, 55, 162/78

[56] References Cited

U.S. PATENT DOCUMENTS

| | | | |
|---|---|---|---|
| 3,791,917 | 2/1974 | Bolton, III | 162/55 |
| 4,187,141 | 2/1980 | Ahrel | 162/26 |
| 4,235,665 | 11/1980 | Reinhall et al. | 162/28 |
| 4,294,653 | 10/1981 | Lindahl et al. | 162/26 |
| 4,402,918 | 3/1985 | Mackie et al. | 162/28 |
| 4,718,980 | 1/1988 | Lowrie et al. | 162/28 |
| 4,732,650 | 3/1988 | Michalowski et al. | 162/78 |
| 4,781,793 | 11/1988 | Halme | 162/55 |
| 4,789,429 | 12/1988 | Jackson et al. | 162/26 |
| 4,938,843 | 7/1990 | Lindhal | 162/55 |
| 5,000,823 | 3/1991 | Lindahl | 162/28 |

FOREIGN PATENT DOCUMENTS

| | | | |
|---|---|---|---|
| 915956 | 12/1972 | Canada | 162/28 |

*Primary Examiner*—W. Gary Jones
*Assistant Examiner*—Todd J. Burns
*Attorney, Agent, or Firm*—Lerner, David, Littenberg, Krumholz & Mentlik

[57] ABSTRACT

Methods for producing mechanical pulp are disclosed including impregnating softwood chips with water and a complexing agent, refining the impregnated chips in a first refining step including a double-disk refiner, fractionating the refined softwood pulp to produce a reject portion comprising beteen about 15 and 35% of the refined pulp and including an increased concentration of the long and stiff fibers therein, refining the reject portion in second and third refining steps in which the second refining step employs a greater concentration of pulp than does the third refining step, and fractionating the refined pulp.

14 Claims, 1 Drawing Sheet

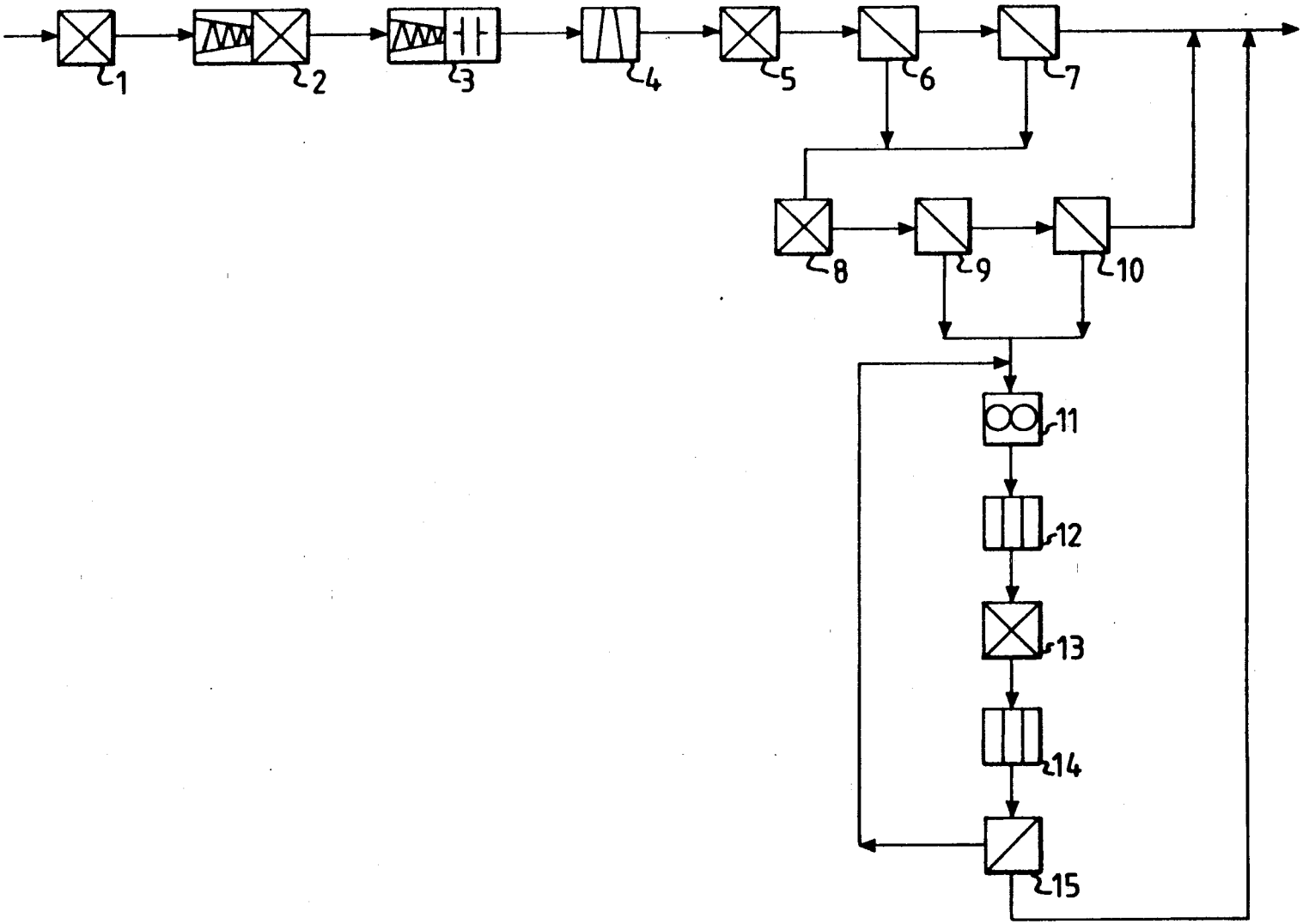
1
2
3
4
5
6
7
8
9
10
11
12
13
14
15

METHOD OF MAKING MECHANICAL PULP

FIELD OF THE INVENTION

The present invention relates to the production of mechanical pulp from softwood. More particularly, the present invention relates to the production of mechanical pulp which is intended for producing coated paper having a low grammage, or so-called LWC-paper (light weight costed), as well as uncoated calendered magazine paper, or so-called FSC-paper (filled supercalendered), or paper of similar quality.

BACKGROUND OF THE INVENTION

The production of the coated papers having low grammage such as those mentioned above creates extremely high demands on the pulp properties, primarily because the pulp is required to have a high strength as well as a low roughness. In addition, these coated papers also require a low porosity, and it is also particularly important that they have a smooth surface structure.

These types of papers normally contain both chemical and mechanical pulps. The mechanical pulp component has traditionally comprised groundwood pulp. More recently, however, thermomechanical pulp (TMP) has been used as an alternative to groundwood. This has had limited success, however, because the concomitant energy consumption is relatively high compared with that in the manufacture of groundwood. Furthermore, in a number of instances the use of TMP has resulted in unevennesses in the surface structure of the paper, which in turn causes poor coating and printability characteristics. These problems could thus be avoided only by the paper manufacturer taking special measures to modify or eliminate the negative effects of the long fiber fraction present in the thermomechanical pulp. The presence of this long fiber fraction negatively affects the smoothness of the paper, because it causes poor formation of the paper and because it contains some long stiff fibers, as well as having poor binding strength. TMP for use in LWC-paper and the like is usually manufactured by refining in two or more steps, with subsequent screening and reject processing, bleaching and post-refining.

SUMMARY OF THE INVENTION

In accordance with the present invention, it is now possible to reduce the energy consumption in the manufacture of thermomechanical pulp while at the same time improving the pulp quality, thus rendering it possible to increase the amount of mechanical pulp in the stock while decreasing the amount of chemical pulp compared with that traditionally used for different paper qualities. This has been accomplished according to the present invention by providing a method for producing mechanical pulp from softwood which comprises impregnating softwood chips with water and a complexing agent, refining the impregnated softwood chips in a first refining step utilizing a pair of counter-rotating refining disks so as to produce a first refined softwood pulp fractionating the first refined softwood pulp so as to produce a first accept portion and a first reject portion, said first reject portion comprising between about 15 and 35% of the first refined pulp and including an increased concentration of long and stiff fibers in the pulp, refining the first reject portion in second and third refining steps so as to produce a second refined softwood pulp the first refining step utilizing a first concentration of softwood pulp and the third refining step using a second concentration of softwood pulp, the first concentration being greater than the second concentration, and fractionating the second refined softwood pulp so as to produce a second accept portion and second reject portion. In a preferred embodiment the impregnation of the softwood chips is carried out at a pH of from about 5 to 9.

In accordance with one embodiment of the method of the present invention, the first refining step is carried out so as to produce a first refined softwood pulp having a long fiber content measured according to Bauer McNett characterization to ≦8% on +16 mesh and ≦26% on 16–30 mesh.

In a preferred embodiment this method includes fractionating the first refined softwood pulp so as to produce a first reject portion comprising between about 18 and 25% of the first refined softwood pulp.

In accordance with another embodiment of the method of the present invention the second refining step is carried out so as to produce a second refined softwood pulp having a fiber length distribution measured according to Bauer McNett characterization to ≦10% on +16 mesh and ≦27% on 16–30 mesh. In a preferred embodiment of the present invention the method includes combining the first and second accept portions.

In a preferred embodiment, the combined accept portions have a long fiber content measured according to Bauer McNett characterization to ≦1% on +16 mesh and ≦21% on 16–30 mesh.

In accordance with another embodiment of the method of the present invention, the first refining step is carried out with an energy input of from about 1800 to 2300 kWh/ton, and preferably between about 1900 and 2100 kWh/ton.

In accordance with another embodiment of the method of the present invention, the second refining step is carried out with an energy input of from about 1000 to 2000 kWh/ton of reject, and preferably from about 1200 to 1500 kWh/ton of reject.

In accordance with another embodiment of the method of the present invention, the third refining step is carried out with an energy input of from about 50 to 300 kWh/ton of reject, and preferably between about 100 and 200 kWh/ton of reject.

Subsequent to impregnation, the first refining step of the present invention is carried out under pressure in a double disk refiner, i.e., a refiner with two counter-rotating disks. Fractionating of the first refined pulp comprises a fractionated screening step of the pulp, preferably carried out in two steps with rescreening of the reject. After dewatering, the screen reject is then refined in two steps, with the first step taking place at high concentration under pressure, preferably in a disk refiner of the single disk type, i.e., with one stationary and one rotating disk, and with the second step being carried out at a low concentration, preferably at a pump-fed disk refiner of the same type as that in the first step.

The present invention implies the maximization of the light-scattering coefficient, and the minimization of the proportion of long fiber proportion in an energy-saving manner in the first and only refining step before screening. It is generally known that double-disk refiners yield a higher light-scattering coefficient and a lower proportion of long fibers than single-disk refiners. It is also known that refining with high specific energy input in a single refining step results in a pulp with shorter fibers than does refining in two steps, unless special measures are taken to prevent same. It is also known that chips which have a low temperature when they pass into the refiner, and thus during the defibering phase, yield a pulp with shorter fibers and with a greater degree of light-scattering than is the case with preheated chips subjected to the same refining energy.

The design of the fractionation step or "screen room" of this invention results in a large proportion of the fibers in the pulp being concentrated in the reject circuit. The reject fraction is thus from about 15 to 35%, and preferably from about 18 to 25% of the total pulp flow. Because the reject portion is refined at high concentrations, the long stiff fibers become more flexible. Subsequent refining at low concentration thus has the object of reducing the amount of long fibers in the pulp. It is generally known that refining at high concentration develops the binding strength of the pulp and increases its density, but that it reduces the long fiber content to only a small extent. This principle applies particularly to the high-concentration refining of a long fiber content reject. It is generally known that the refining of long-fiber reject at low concentration results in a substantial shortening of the fibers, unless special measures are taken to prevent same.

Therefore, by employing the present invention, the total energy consumption for the refining is not only reduced because the refining is carried out in a single step in a double-disk refiner, but also because the final refining of the pulp takes place on the smaller amount of the pulp containing the long fibers, which are to be rendered more flexible and shorter.

BRIEF DESCRIPTION OF THE FIGURES

The present invention can be more fully understood with reference to the following detailed description which itself refers to the accompanying FIGURE which shows a flow chart of the method of the present invention.

DETAILED DESCRIPTION

Pretreatment of the raw material in the form of spruce chips in accordance with this invention as shown in the FIGURE is carried out by a washing and atmospheric steaming step 1 followed by water impregnation 2 with complex-forming agent present within a pH range of from about 5 to 9. The pretreated material is then refined under pressure in a double-disk refiner 3. The refining in this first step is carried out with an energy input of about 2000 kWh/ton, and yields a pulp with a freeness value according to CSF of 95 ml and a fiber length distribution according to Bauer McNett characterization as follows:

| | |
|---|---|
| +16 | 5–8% |
| 16/30 | 24–26% |
| −200 | 26–28% |

After steam separation in a pressure cyclone 4, latency is removed in a vat 5. Thereafter, a fractionating screening step is carried out on the pulp in two steps in primary screens 6 and 7, which are pressure screens with mesh sizes of 1.8 mm and 1.6 mm, respectively. The reject portion withdrawal amounts to 20% and 25%, respectively. The resulting accept portion has a freeness value according to CSF of 40 ml and a fiber distribution according to Bauer McNett characterization as follows:

| | |
|---|---|
| +16 | 0–2% |
| 16/30 | 20–22% |
| −200 | 38–40% |

The screen rejects are combined in vat 8 and rescreened in two steps in secondary screens 9 and 10, which are pressure screens with mesh sizes of 2.2 mm and 2.0 mm, respectively. The reject withdrawal amounts to 25% and 30%, respectively.

The combined rejects from these secondary screens 9 and 10 amounts to 19% of the entire pulp flow, and has the characteristics as follows:

| Freeness 450 ml CSF | |
|---|---|
| +16 | 40–44% |
| 16/30 | 26–28% |
| −200 | 4–6% |

This reject portion is then passed through a dewatering press 11 where the concentration is increased from about 20 to 35%, whereafter the reject is refined in a pressure refiner 12 with an energy input of about 1250 kWh/ton. The resulting pulp characteristics are as follows:

| Freeness 110 ml CSF | |
|---|---|
| +16 | 25–28% |
| 16/30 | 25–28% |
| −200 | 8–11% |

This refined reject portion is then diluted in a vat 13 to a concentration of about 5%, and refined in a single-disk refiner 14, which renders possible precision adjustment of the gap between the disks. With an energy input of 150 kWh/ton a reduction of the long fiber content by about 70% is obtained, and the reject portion shows the following characteristics:

| Freeness 80 ml CSF | |
|---|---|
| +16 | 8–10% |
| 16/30 | 25–27% |
| −200 | 9–12% |

The refined reject portion is then screened in one step with a reject screen 15, which is a pressure screen with a mesh size of 1.8 mm and a reject withdrawal of 10%.

The accept portion from this reject screen 15 and from the two secondary screens 9 and 10, combined with the accept portion from the two primary screens 6 and 7, constitute the final pulp, which is dewatered to be bleached with dithionite or peroxide to a suitably diffuse blue reflectance.

The final unbleached pulp, manufactured with a total refining energy of 2250 kWh/ton, has the following fiber characteristics:

| Freeness 50 ml CSF | |
|---|---|
| +16 | ≦1% |
| +30 | ≦21% |

-continued

| Freeness 50 ml CSF | |
|---|---|
| −200 | ≧34% |

and the pulp characteristics according to TAPPI test standard as follows:

| | |
|---|---|
| Tensile index | ≧52 Nm/g |
| Tear index | ≧6.5 $nMn^2/g$ |
| Density | ≧450 $m^3/kg$ |
| Smoothness | ≦110 ml/min |
| Light-scattering | ≧64 $m^2/kg$ |

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for producing mechanical pulp from softwood comprising impregnating softwood chips with water and a complexing agent, refining said impregnated chips in a first refining step utilizing a pair of counter-rotating refining discs so as to produce a first refined pulp, fractionating said first refined pulp so as to produce a first accept portion and a first reject portion, said first reject portion comprising between about 15 and 35% of said first refined pulp and including an increased concentration of the long and stiff fibers in said pulp, refining said first reject portion in second and third refining steps so as to produce a second refined pulp, said second refining step utilizing said first reject portion having a consistency of about 20–35% and said third refining step utilizing said first reject portion having a consistency of about 5%, and fractionating said second refined pulp so as to produce a second accept portion and a second reject portion.

2. The method of claim 1 wherein said impregnating of said softwood chips is carried out at a pH of from about 5 to 9.

3. The method of claim 1 wherein said first refining step is carried out so as to produce the first refined pulp having a long fiber content measured according to Bauer McNett characterization to ≦8% on +16 mesh and ≦26% on 16–30 mesh.

4. The method of claim 1 including fractionating said first refined pulp so as to produce a first reject portion comprising between about 18 and 25% of said first refined pulp.

5. The method of claim 1 wherein said second and third refining steps are carried out so as to produce the second refined pulp having a fiber length distribution measured according to Bauer McNett characterization to ≦10% on +16 mesh and ≦27% on 16–30 mesh.

6. The method of claim 1 including combining said first and second accept portions.

7. The method of claim 1 wherein said mechanical pulp is intended for coated lightweight paper and uncoated uncalendered magazine paper.

8. The method of claim 6 wherein said combined accept portions have a long fiber content measured according to Bauer McNett characterization to ≦1% on +16 mesh and ≦21% on 16–30 mesh.

9. The method of claim 1 wherein said first refining step is carried out with an energy input of from about 1800 to 2300 kWh/ton.

10. The method of claim 9 wherein said energy input is between about 1900 to 2100 kWh/ton.

11. The method of claim 1 wherein said second refining step is carried out with an energy input of from about 1000 to 2000 kWh/ton of reject.

12. The method of claim 11 wherein said energy input is from about 1200 to 1500 kWh/ton of reject.

13. The method of claim 1 wherein said third refining step is carried out with an energy input of from about 50 to 300 kWh/ton of reject.

14. The method of claim 13 wherein said energy input is between about 100 and 200 kWh/ton of reject.

* * * * *

UNITED STATES PATENT AND TRADEMARK OFFICE

CERTIFICATE OF CORRECTION

PATENT NO. : 5,145,010

DATED : September 8, 1992

INVENTOR(S) : Danielsson et al.

It is certified that error appears in the above-identified patent and that said Letters Patent is hereby corrected as shown below:

In the 57 Abstract, line 7, "beteen" should read --between--.
Column 1, line 10, "costed" should read --coated--.
Column 6, line 24, "uncalendered" should read --calendered--.

Signed and Sealed this

Fourteenth Day of September, 1993

Bruce Lehman

*Attest:*

BRUCE LEHMAN

*Attesting Officer*

*Commissioner of Patents and Trademarks*